United States Patent [19]

Asano et al.

[11] 4,235,947

[45] Nov. 25, 1980

[54] METHOD FOR THE MANUFACTURE OF A STEEL SHEET ADAPTED FOR USE IN IRONING PROCESSING HAVING GOOD LUBRICATION PROPERTY

[75] Inventors: Hidejiro Asano; Shigeyoshi Maeda; Yashichi Oyagi, all of Kitakyushu, Japan

[73] Assignee: Nippon Steel Corporation, Tokyo, Japan

[21] Appl. No.: 616,202

[22] Filed: Sep. 24, 1975

[30] Foreign Application Priority Data

Sep. 25, 1974 [JP] Japan ..... 49-109475
Sep. 25, 1974 [JP] Japan ..... 49-109476

[51] Int. Cl.[3] ..... B05D 3/02

[52] U.S. Cl. ..... 427/226; 72/42; 148/6.16; 427/229

[58] Field of Search ..... 427/229, 156, 226; 72/42; 148/6.16

[56] References Cited

U.S. PATENT DOCUMENTS

| | | | |
|---|---|---|---|
| 2,250,940 | 7/1941 | Zahn et al. | 427/156 |
| 2,479,762 | 8/1949 | Morris | 427/156 |
| 2,492,848 | 12/1949 | Crouch et al. | 427/156 |
| 2,527,828 | 10/1950 | Kruszynski et al. | 148/6.16 |
| 2,686,732 | 8/1954 | Montgomery et al. | 427/156 |
| 3,202,523 | 8/1965 | Steeg | 427/156 |
| 3,215,533 | 11/1965 | Krey | 427/229 |
| 3,222,226 | 12/1965 | Maurer et al. | 148/6.16 |
| 3,492,258 | 1/1970 | Kremer | 427/156 |
| 3,519,495 | 7/1970 | Plaxton | 148/6.16 |
| 3,677,797 | 7/1972 | Asano et al. | 427/229 |
| 3,715,231 | 2/1973 | Ng et al. | 427/229 |
| 3,801,363 | 4/1974 | Buck | 427/229 |
| 3,894,847 | 7/1975 | Asano et al. | 427/229 |
| 3,963,472 | 6/1976 | Young | 148/6.16 |

*Primary Examiner*—Michael R. Lusignan
*Assistant Examiner*—Janyce A. Bell
*Attorney, Agent, or Firm*—Watson, Leavenworth, Kelton & Taggart

[57] ABSTRACT

A complex film is formed on a steel sheet by coating thereto an aqueous solution of ammonium phosphate, ammonium molybdate, nickel aceptate, etc., heating the same and further coating a lubrication oil containing an animal or vegetable oil or fat or a mineral oil with a high molecular compound and a higher fatty acid, whereby a steel sheet showing excellent lubricity in ironing is given. The effect can be improved by adding cobalt, nickel, chrome salts to the aqueous solutions.

7 Claims, No Drawings

METHOD FOR THE MANUFACTURE OF A STEEL SHEET ADAPTED FOR USE IN IRONING PROCESSING HAVING GOOD LUBRICATION PROPERTY

DETAILED DESCRIPTION OF THE INVENTION

This invention relates to a method for the manufacture of a lubrication-applied and surface-treated steel sheet having excellent processing for ironing, and more particularly to such method wherein a surface film formed by thermal decomposition and a high molecular lubrication oil film creates a complex lubrication film which will exert a quite excellent lubrication effect when the ironing is effected.

The "ironing" is a method which, after squeezing a sheet by the use of a suitable punch and die to form a cup, elongates the side wall of said cup by the use of a punch and die having a clearance between the die and the punch smaller than the thickness of said side wall of said squeezed cup, while decreasing the thickness of said side wall to obtain a cup-like container. After an end plate is fixed thereto, the so-called two-piece can is obtained.

The aforesaid ironing is a severe processing to a material. Accordingly, when a steel sheet is subjected to the processing by the use of a normal cutting or machine oil, a phenomenon of scorch occurs between the die and the material, which gives rise to deep linear scars on the surface of the body of the can. At the worst condition, the body is broken whereby the processing becomes impossible. In order to prevent such occurrence of the scars, it is considered effective to allow a lubrication film to intervene between the die and the material so that a direct contact there between can be avoided. The inventors of this invention have found that, for the purpose of giving such lubrication film or fluid lubrication condition having strong resistance to compression and shearing, an animal or vegetable oil or fat such as tallow, whale oil, palm oil, cottenseed oil and the like or a mineral oil such as cutting oil, machine oil, spindle oil and the like added with a high molecular compound such as polypropylene, polybutene, acrylic resin and the like and a higher fatty acid such as lauric acid, oleic acid and the like is very effective and that if its added to the lubrication oil, a quite excellent resistance to the scars can be obtained. However, when the amount of the above oil applied becomes small, for example, 1 $g/m^2$ or less; the scars can not always be prevented. On the other hand when the amount of the oil applied becomes great, the oil is accumulated in the tools so that the workability becomes degraded.

It is therefore an object of this invention to overcome the above defects.

It is a second object of this invention to provide a method in which a film having a good lubrication property is allowed to first exist on the surface of a material steel sheet to give a synergetic effect by said film and the aforesaid lubrication oil, whereby an ironing processing having both excellent lubrication property and workability is made possible.

According to this invention, there is provided a method (1) for the manufacture of a steel sheet adapted for use in ironing having good lubrication property which is treated by applying to the surface of said steel sheet one aqueous solution selected from the group consisting of (a) an aqueous solution of ammonium phosphate, (b) an aqueous solution of ammonium molybdate, (c) a mixed aqueous solution of ammonium phosphate and ammonium molybdate and (d) an aqueous solution of nickel salt, heating said steel sheet in an atmosphere of an inert or reducing gas to form a surface film caused by the thermal decomposition thereof, and thereafter applying thereto a lubrication oil consisting essentially of (a) an animal or vegetable oil or fat or a mineral oil, as a basic oil, (b) a high molecular compound and (c) a higher fatty acid.

According to this invention, there is also provided a method (2) according to the method (1) in which, in case that an aqueous solution of ammonium phosphate is applied, one or two members selected from the group consisting of (a) nickel ion and (b) chromium ion are added to said solution before use.

According to this invention, there is also provided a method (3) according to the method (1) in which, in case that an aqueous solution of ammonium molybdate is applied, one or two members selected from the group consisting of (a) nickel ion and (b) chromium ion are added to said solution before use.

According to this invention, there is also provided a method (4) according to the method (1) in which, in case that a mixed aqueous solution of ammonium phosphate and ammonium molybdate is applied, one or two members selected from the group consisting of (a) nickel ion and (b) chromium ion are added to said solution before use.

According to this invention, there is also provided a method (5) according to the method (1) in which, in case that an aqueous solution of nickel salt is applied, one or two members selected from the group consisting of (a) cobalt ion and (b) chromium ion are added to said solution before use.

According to this invention, there is also provided a method (6) according to the method (1) in which said animal or vegetable oil or fat is selected from the group consisting of (a) tallow, (b) whale oil, (c) palm oil and (d) cottenseed oil, and said mineral oil is selected from the group consisting of (a) cutting oil, (b) machine oil and (c) spindle oil.

According to this invention, there is also provided a method (7) according to the method (1) in which said high molecular compound is selected from the group consisting of (a) polypropylene, (b) polybutene, and (c) acrylic resin, and said higher fatty acid is selected from the group consisting of (a) lauric acid, (b) oleic acid and (c) stearic acid.

According to this invention, there is also provided a method (8) according to the method (1) in which the heating temperature is between 200° C. and 750° C.

According to this invention, there is also provided a method (9) according to the method (1) in which an aqueous solution of the ammonium phosphate is selected from the group consisting of (a) diammonium hydrogen phosphate and (b) ammonium dihydrogen orthophosphate; an aqueous solution of the ammonium molybdate is selected from the group consisting of (a) ammonium dodecamolybdate and (b) ammonium heptamolybdate; and an aqueous solution of the nickel salt is selected from the group consisting of (a) nickel acetate, (b) nickel formate, (c) nickel oxalate and (d) nickel nitrate.

According to this invention, there is also provided a method (10) according to the methods (2) to (4) in which a source for said nickel ion is selected from the group consisting of (a) nickel acetate and (b) nickel nitrate, and a source for said chromium ion is selected from the group consisting of (a) chromium acetate and (b) chromium nitrate.

Accroding to this invention, there is also provided a method (11) according to the method (5) in which a source for said chromium ion is selected from the group consisting of (a) chromium acetate and (b) chromium nitrate, and a source for said cobalt ion is cobalt nitrate.

In the practice of this invention, a steel sheet which has preliminarily been degreased and washed is dipped in an aqueous solution of ammonium phosphate, ammonium molybdate or nickel acetate whereby the salt is coated on the steel sheet in a suitable amount by means of roll squeezing technique. Thereafter the sheet is dried by hot blast, and subjected to a heat treatment. The heat treatment is effected in the presence of a non-oxidizing gas such as $N_2$, $H_2$, mixture of $N_2$ and $H_2$, or Ar and the like. The heating temperature should preferably be between 200° C. and 750° C. As a result of the heat treatment, the ammonium phosphate, the ammonium molybdate or the nickel acetate is decomposed to form a film on the surface which is chiefly composed of phosphorus, molybdenum or nickel. The exact composition of the film is not known but it is presumed to be iron phosphate, molybdenum oxide, metallic molybdenum, metallic nickel, nickel oxide, or mixture thereof. The film thus formed will act to enhance the preservation of a lubrication oil having the aforesaid fundamental composition which is to be subsequently coated, and show an excellent resistance to the scar with an aid of a lubrication effect of the film itself.

An aqueous solution of ammonium phosphate and/or ammonium molybdate to be coated or applied may be, for example, diammonium hydrogen phosphate, ammonium dihydrogen orthophosphate, ammonium dodecamolybdate, ammonium heptamolybdate and the like.

An aqueous solution of nickel salt to be coated or applied may be, for example, nickel formate, nickel oxalate, nickel nitrate and the like as well as nickel acetate, for the aqueous solutions for these substances are susceptible to thermal decomposition at a relatively low temperature to form Ni or NiO. However, it should not be limited to the aforesaid four nickel salts so long as it is a nickel compound which can produce Ni or NiO by thermal decomposition in the non-oxidizing gas condition.

When the ammonium phosphate and/or the ammonium molybdate is applied as an aqueous solution containing Ni ion or Cr ion, that is, as an aqueous solution to which a source for supplying Ni ion or Cr ion capable of being thermally decomposed within the range of the above-stated heat treatment temperatures has been added, a complex film can be formed on the surface of the steel sheet by the heat treatment. The source for supplying Ni or Cr ion may be such Ni salt as nickel acetate or nickel nitrate, etc. or such chromium salt as chromium acetate or chromium nitrate, etc. The complex film formed is presumed to be Ni, NiO or a complex substance thereof; Cr, $Cr_2O_3$ or a complex substance thereof. This film will show not only remarkable lubrication property but also excellent corrosion resistance as compared with the case of using the single ammonium phosphate or the single ammonium molybdate.

Similarly, when an aqueous solution of the nickel salt containing Cr ion or Co ion obtained by adding an aqueous solution of the nickel salt with a source for supplying Cr ion such as chromium acetate, chromium nitrate, etc. or Co ion such as cobalt nitrate, etc. is used, a complex film can be formed by the heat treatment, which film contains in the nickel film the chromium or cobalt probably in a metallic or oxide form. The film will also show not only remarkable lubrication property but also excellent corrosion resistance as compared with the case of using the single nickel salt.

The film amount of the aqueous solution thus treated should preferably be 2 to 200 mg/m$^2$ in case of the aqueous solution of ammonium phosphate, 5 to 300 mg/m$^2$ in case of the aqueous solution of ammonium molybdate and 5 to 300 mg/m$^2$ in case of the aqueous solution of nickel. The optimum lubrication effect can be obtained in the range of the above amount.

The reason why the steel sheet having the above-mentioned thermally decomposed film shows a quite excellent adaptability for ironing processing by means of a high-molecule-containing lubrication oil is not known. According to an inspection by microscope of the surface of such steel sheet after processing, a lot of extremely thin lines can be observed thereon. This condition does not change at all even if a great number such as 100 or more of cans are subjected to continuous ironing processing. On the other hand, when a steel sheet having no such film on the surface is subjected to ironing processing by the use of ordinary cutting oil, the thin lines which has appeared in the first one or two cans become deep and increase in number rapidly as the processed cans increase, which finally results in undesirable clear scars. From this it is considered that the film subjected to thermal decomposition according to this invention is scraped by the ironing processing as fine powders, and that the powders themselves will act in the high-molecule-containing lubrication film as the solid lubricant to thereby prevent the melt-adhesion between the die and the material which is the cause for the scars. However, even when a steel sheet having the aforesaid film subjected to the thermal decomposition is used, the deep scars will still appear so far as the ironing processing is conducted by the use of the ordinary cutting oil. In view of this, a perfect ironing processing is possible only with a combination of the thermally decomposed film and the high-molecule-containing lubrication film according to this invention.

EXAMPLE 1

A cold rolled steel sheet of 0.35 mm thickness before annealing was subjected to degreasing and washing. It was dipped into various treating solutions as shown in Table 1 which consisted mainly of ammonium phosphate or ammonium molybdate, and then dried by hot blast after or without roll squeezing. It was subsequently heated at a temperature of 600° C. or so in an atmosphere of $N_2$ plus $H_2$ mixed gas, so that the thermal decomposition of the coated agent and the annealing for removal of strain was concurrently effected. A film was thus formed. A skin-pass rolling was then carried out under a reduction rate of 1%. The surface-coated steel sheet thus obtained was further coated with high-molecule-containing lubrication oils shown in Table 1 and thereafter subjected to ironing processing. The ironing processing was conducted in continuously making a lot of cans, using an Erichsen testing machine and the lubrication property was evaluated by the number of cans at which the scars appeared.

The condition for ironing processing was as follows:

| | | |
|---|---|---|
| (a) | Cupping: | one step. |
| (b) | Ironing: | two steps. |
| (c) | Dia. of Can: | 50 mm. |
| (d) | Processing rate for Ironing (Rate of decrease of thickness): | 70% |

decomposition of the coated agent and the annealing for removal of strain was concurrently effected. A nickel-base film was thus formed. A skin-pass rolling was then carried out under a reduction rate of 1%. The surface-coated steel sheet thus obtained was further coated with high-molecule-containing lubrication oils shown in Table 2 and thereafter subjected to ironing processing. The ironing processing in continuously making a lot of cans, using an Erichsen testing machine and the lubrication property was evaluated by the number of cans at which the scars appeared.

TABLE 1

| No. | Composition for treating bath | | Treating method | Composition & amount of lubrication oil | | Number of cans of give scars |
|---|---|---|---|---|---|---|
| 1 | Diammonium hydrogen phosphate | 15 g/l | Dip coating, hot blast drying, heat treatment, $H_2$ 10% + $N_2$ 90% gas, 600° C. heating. | Tallow 70% + polypropylene(molecular weight 10,000, atactic) 20% + lauric acid 10%. Amount applied: 1 g/m$^2$ | | >200 |
| 2 | Ammonium dodecamolybdate | 20 g/l | | | | >200 |
| 3 | Diammonium hydrogen phosphate | 10 g/l | | | | |
| | Ammonium dodecamolybdate | 10 g/l | | | | >200 |
| 4 | Diammonium hydrogen phosphate | 10 g/l | Dip coating, roll squeezing, heat treatment, $H_2$ 10% + $N_2$ 90% gas, 630° C. heating. | Spindle oil 70% + polypropylene(molecular weight 12,000, atactic) 20% + oleic acid 10%. Amount applied: 1 g/m$^2$ | | >200 |
| | Nickel acetate | 10 g/l | | | | |
| 5 | Ammonium heptamolybdate | 10 g/l | | | | >200 |
| | Chromium acetate | 10 g/l | | | | |
| 6 | Ammonium dihydrogen orthophosphate | 10 g/l | | | | >200 |
| | Nickel nitrate | 10 g/l | | | | |
| 7 | Same as No. 1 | | Dip coating, heat treatment Argon gas 600° C. heating | Tallow 60% + polybutene (molecular weight 2000) 30% + lauric acid 10%. Amount applied: 1.5 g/m$^2$ | | >200 |
| 8 | Same as No. 2 | | | | | >200 |
| 9 | Same as No. 3 | | | | | >200 |
| 10 | No treatment | | — | Palm oil 70% plypropylene 20% lauric acid 10% | 0.5 g/m$^2$ | 160 |
| 11 | No treatment | | — | | 10 g/m$^2$ | >200 |
| 12 | No treatment | | — | Cutting oil #620 | 10 g/m$^2$ | <5 |

In the above Table 1 or Table 2 hereinafter shown, the "atactic" polypropylene means one of the three isomers of the polypropylene.

EXAMPLE 2

A cold rolled steel sheet of 0.35 mm thickness before annealing was subjected to degreasing. It was coated with such aqueous solutions of nickel salts or mixture thereof as shown in Table 2, and then dried by hot blast after or without roll squeezing. It was subsequently heated at a temperature of 600° C. or so in an atmosphere of $N_2$ plus $H_2$ mixed gas, so that the thermal The condition for ironing processing was as follows:

| | | |
|---|---|---|
| (a) | Cupping: | one step. |
| (b) | Ironing: | two steps. |
| (c) | Dia. of Can: | 50 mm. |
| (d) | Processing rate for Ironing (Rate of decrease of thickness): | 70% |

| No. | Composition for treating bath | | Treating method | Composition & amount of lubrication oil | Number of cars of give scars |
|---|---|---|---|---|---|
| 1 | Nickel acetate | 20 g/l | Dip coating hot blast drying, heat treatment, 600° C. ($H_2$ 10% + $N_2$ 90%) Mix gas | Tallow 70% + polypropylene(molecular weight 10,000, atactic) 20% + lauric acid 10%. Amount applied: 1 g/m$^2$ | >200 |
| 2 | Nickel nitrate | 20 g/l | | | >200 |
| 3 | Nickel acetate | 15 g/l | Same as above | Spindle oil 70% + polypropylene(molecular weight 12,000, atactic) 20% + oleic acid 10%. Amount applied: 1 g/m$^2$ | >200 |
| | Chromium acetate | 5 g/l | | | |
| 4 | Nickel acetate | 15 g/l | Dip coating, roll squeezing, heat treatment; 630° C. Mix gas | Palm oil 80% + Polymethacrylate (molecular weight 10,000) 10% + stearic acid 10%. Amount applied: 1 g/m$^2$ | >200 |
| | Cobalt nitrate | 5 g/l | | | |
| 5 | Same as No. 1 | | Dip coating, roll squeezing, heat treatment | Tallow 70% + polybutene (average molecular weight 2,000) 20% + lauric | >200 |

-continued

| No. | Composition for treating bath | Treating method | Composition & amount of lubrication oil | | Number of cars of give scars |
|---|---|---|---|---|---|
| | | 630° C. Ar gas | acid 10%. Amount applied: 1 g/m$^2$ | | |
| 6 | No treatment | — | Palm oil 70% Polypropylene 20% | 0.5 g/m$^2$ | 160 |
| 7 | No treatment | — | Oleic acid 10% | 10 g/m$^2$ | >200 |
| 8 | No treatment | — | Cutting oil | | <5 |

We claim:

1. A method for applying a lubrication coating to a steel sheet which is to be subjected to an ironing operation, said method comprising applying an aqueous solution containing ammonium phosphate to the surface of said steel sheet, heating said sheet in a non-oxidizing atmosphere to thermally decompose said solution and form a surface film therewith on said sheet, and thereafter, applying to said film a lubrication oil consisting of (a) at least one member selected from the group consisting of animal oil, vegetable oil, fat, and mineral oil, (b) a polymeric material, and (c) a higher fatty acid.

2. A method according to claim 1 in which at least one member selected from the group consisting of nickel ion and chromium ion, are added to said aqueous solution before use.

3. A method according to claim 1 in which the animal oil is selected from the group consisting of tallow and whale oil, the vegetable oil is selected from the group consisting of palm oil and cottonseed oil, and the mineral oil is selected from the group consisting of cutting oil, machine oil and spindle oil.

4. A method according to claim 1 in which the polymeric material is selected from the group consisting of polypropylene, polybutene and acrylic resin, and said higher fatty acid is selected from the group consisting of lauric acid, oleic acid and stearic acid.

5. A method according to claim 1 in which the heating temperature is between 200° C. and 750° C.

6. A method according to claim 1 in which said ammonium phosphate contained in said aqueous solution is selected from the group consisting of diammonium hydrogen phosphate and ammonium dihydrogen orthophosphate.

7. A method according to claim 2 in which the source for the nickel ion member is selected from the group consisting of nickel acetate and nickel nitrate, and the source for the chromium ion member is selected from the group consisting of chromium acetate and chromium nitrate.

* * * * *